US005205070A

United States Patent [19]

Lundström

[11] Patent Number: 5,205,070

[45] Date of Patent: Apr. 27, 1993

[54] DOOR MANEUVERING ARRANGEMENT

[75] Inventor: Lars B. Lundström, Stockholm, Sweden

[73] Assignee: Megadoor AB, Skelleftea, Sweden

[21] Appl. No.: 834,889

[22] Filed: Feb. 11, 1992

[30] Foreign Application Priority Data

Feb. 26, 1991 [SE] Sweden ..... 9100551

[51] Int. Cl.[5] ..... E05F 15/00

[52] U.S. Cl. ..... 49/200; 160/189; 160/201

[58] Field of Search ..... 49/200; 160/189, 190, 160/193, 201, 206, 207

[56] References Cited

U.S. PATENT DOCUMENTS

| | | | |
|---|---|---|---|
| 538,431 | 4/1895 | McKenzie | 160/190 |
| 1,385,023 | 7/1921 | Parodi et al. | 160/189 |
| 1,709,872 | 4/1929 | Peelle | 160/189 |
| 2,533,423 | 12/1950 | Bunch | 49/200 |
| 4,887,658 | 12/1989 | Cloutier | 160/190 |

*Primary Examiner*—Philip C. Kannan
*Attorney, Agent, or Firm*—Michael, Best & Friedrich

[57] ABSTRACT

A drive arrangement for maneuvering a generally vertically moveable door, the arrangement comprising at least one bendable door lifting element which is connected to at least one of the two longitudinal side edges of the door. In order to enable the force required to maneuver the door to be held substantially constant, or to vary only significantly over the full opening range of the door, particularly in the case of doors of the kind in which the force required to open or maneuver the door increases with the extent to which the door is opened, the door lifting element has connected thereto an elongated, bendable counterbalance device, and the door lifting element will function to move the counterbalance device between an inactive position, in which it is generally horizontal, and an active position in which at least a part of the weight of the counterbalance device will exert a lifting force on the door through the intermediary of the door lifting element.

19 Claims, 1 Drawing Sheet

DOOR MANEUVERING ARRANGEMENT

The present invention relates to a drive arrangement for manoeuvering a generally vertically moveable door of a door assembly, said arrangement comprising a bendable lifting element which is intended for moving the door and which is connected to at least one of the two side edges thereof.

One drawback with many door manoeuvering mechanisms of this kind is that the weight of the door is not balanced-out in all positions of the door, which places demands on the ability of the components of said mechanisms, particularly the drive motor, to handle loads of varying magnitudes. This applies in particular to vertical moveable doors of the kind in which the force required to open the door increases with the height to which the door is raised.

It is therefore an object of the present invention to provide a door opening arrangement of the aforesaid kind in which the requisite door manoeuvering or door opening force is maintained generally constant or will vary only negligibly over the door throughout the whole of the door opening range.

This object is achieved by means of a door opening arrangement having the characteristic features set forth in the following claims.

As a result of connecting the bendable or flexible lifting element to an elongated counterweight device which is also bendable, or flexible, and which is intended to be moved by the lifting element between a position in which said counterweight device is generally horizontal and a position in which at least a part of the weight of said counterweight device exerts a lifting force on the door through the intermediary of the lifting element, doors of the aforesaid kind with which the force required to open said doors increases with the height to which the door is raised can be balanced in each position of the door during the whole of a door opening or door closing movement, thereby obviating the need to dimension the door manoeuvering arrangement for loads from the whole of the door, said arrangement needing only to be dimensioned for other loads, such as inertia and friction in the mechanism.

Figure 1:
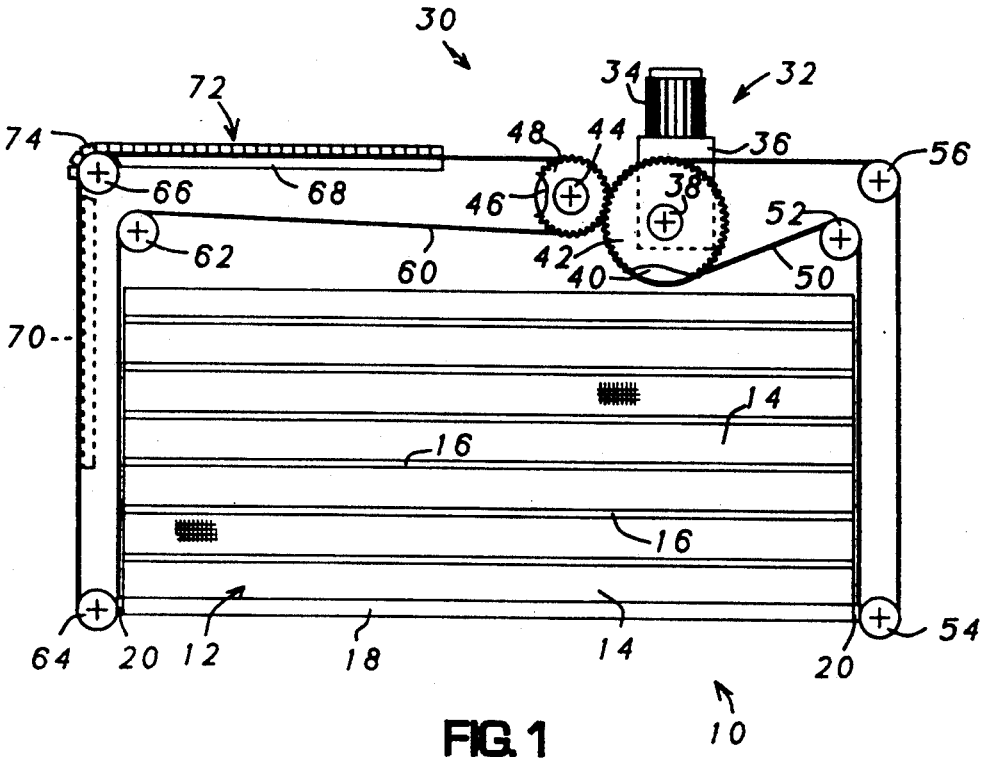
Figure 2:
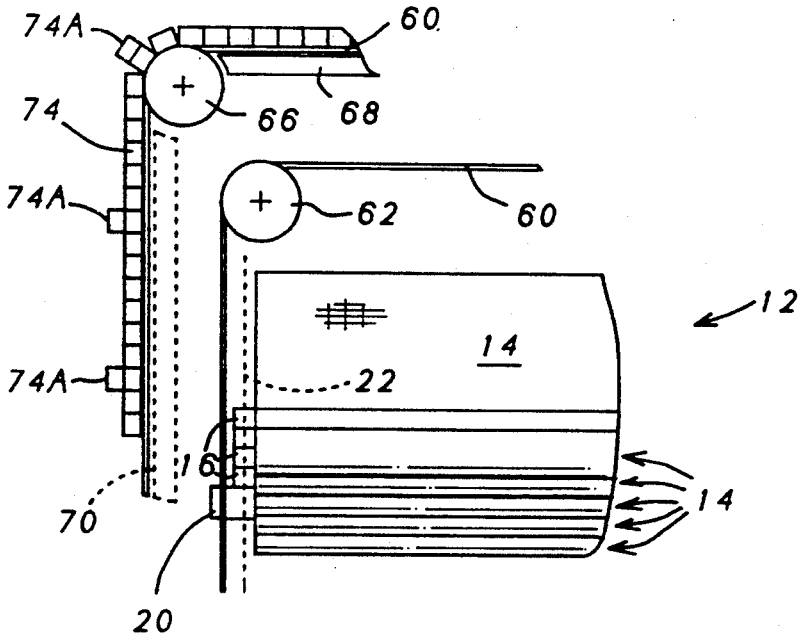

Other features of the invention and advantages afforded thereby will be evident from the following claims and from the following description, which is made with reference to the accompanying drawing, in which FIG. 1 is a schematic illustration of a door fitted with an inventive door manoeuvering arrangement; and FIG. 2 illustrates part of the arrangement shown in FIG. 1 with the door in a partially open position.

The arrangement illustrated in FIG. 1 includes a vertically moveable door assembly, generally referenced 10, intended for an industrial building (not shown) for instance. In the illustrated embodiment, the actual door 12, is comprised of a fabric material 14 with intermediate bars or struts 16 extending across the width of the door in mutually spaced arrangement. The door is terminated at the bottom with a bottom bar 18. As indicated at 22 in FIG. 2, the ends of the bars are preferably guided in some suitable manner adjacent the door assembly frame structure (not shown) which defines the door opening.

The door is manoeuvred by means of a door manoeuvering system, generally referenced 30, which includes a drive unit 32 in the form of an electric motor 34 fitted with a gearbox 36. The drive unit 32 preferably also includes safety devices, such as torque limiters in the form of a friction coupling on the motor axle, and an emergency door manoeuvering facility (not shown).

Solidly mounted on the output shaft 38 of the gearbox 36 of said drive unit 32 is a toothed belt pulley 40 which coacts with a first, endless, toothed drive-belt 50, and a toothed wheel 42. The toothed wheel 42 meshes with and drives a further toothed wheel 48 solidly mounted on a journalled shaft 44, wherein also solidly mounted on the shaft 44 is a toothed belt pulley 46 which coacts with a second, endless toothed drive-belt 60. In the case of the arrangement illustrated schematically in FIG. 1, the drive-belts 50, 60 are synchronized to rotate at mutually the same peripheral speeds, via the gearing formed by the toothed wheels 42, 48. This gearing need not be a gearwheel-type gearing, but may be comprised advantageously of other types of gears, such as chain gears and toothed-belt gears. The first and the second toothed drive-belts 50 and 60 are oriented in respective vertical loops by means of direction pulleys 52, 54, 56 and 62, 64, 66, which need not be toothed, in the vicinity of the vertical side edges of the door 12, where the inner part of each belt loop, 50 and 60, is fixedly connected to the end extremities of the bottom bar 18 by means of suitable joints 20, 20, for example shape-forming clamping joints, which engage with the teeth (not shown) on said belts 50, 60 and which may also function to join together the ends of the originally non-endless drive belts.

In accordance with the present invention, a counterweight device 72 having the form of a plurality of weights 74 made of a suitable high-density material, such as lead, are securely attached sequentially to the toothed drive-belt 60 on the upper horizontal part of the toothed drive-belt in the lower position of the door 12, as shown to the left in FIG. 1. The drive belt 60 is supported in this upper, horizontal belt-part by a fixed, elongated and generally horizontal support 68 which functions to prevent the drive belt from bending outwards and also to take-up the weight of the bodies 74 when the door 12 is not completely open. The expression "generally horizontal" as used in the following claims is also meant to include minor deviations of the lifting element 60 and the support 68 from the horizontal, for example to possibly compensate for frictional forces. As indicated in broken lines in FIGS. 1 and 2, the outer, vertical part of the drive belt 60 may also be supported by a similar support 70, wherein the bodies 74 are located on the vertical part of the belt 60 and the door leaf 12 is fully or partially open.

When opening or closing the door 12, the bodies 74 forming the counterweight device 72 are thus distributed between the inactive horizontal position and the active vertical position, where the bodies are able to balance the weight of the fully open or partially open door gravitationally.

As indicated in chain lines in FIG. 2, certain of the bodies 74A may be made heavier than the remaining bodies 74, since the force required to open the illustrated door does not vary continuously, but will vary abruptly when an underlying bar 16 comes into contact with the overlying bar 16, as indicated in chain lines in FIG. 2. The spacing between the bodies 74A on the drive belt 60 will thus correspond to the spacing between the bars 16 on the door 12.

The aforedescribed arrangement can be modified in different ways within the scope of the following claims, by one skilled in this art. For example, the lifting element may comprise one or more drive devices of a kind other than the aforedescribed two endless drive belts, such as cables, chains and the like.

I claim:

1. A drive arrangement for manoeuvering a substantially vertically moveable door, comprising a bendable door lifting element which is connected at least to one of the two longitudinal side edges of the door, characterized in that connected to the door lifting element (60) is an elongated, bendable counterweight device (72) which is intended to be moved by the door lifting element (60) between an inactive position in which the counterweight device is generally horizontal and an active position in which at least part of the weight of the counterbalance device exerts a lifting force on the door (12) through the intermediary of said door lifting element.

2. An arrangement according to claim 1, characterized in that the counterbalance device (72) includes a plurality of mutually separate bodies (74) which are connected to the lifting element (60) in sequential relationship.

3. An arrangement according to claim 2, characterized in that the lifting element includes at least one endless drive belt.

4. An arrangement according to claim 1, characterized in that the lifting element includes at least one endless drive belt (60).

5. An arrangement according to claim 4, characterized in that the drive belt (60) is a toothed belt which is intended to coact with a belt pulley (46) and guide pulleys (62, 64, 66), and in that said counterbalance device (72) is formed on the non-toothed side of said toothed belt.

6. An arrangement according to claim 5, characterized in that the arrangement includes two toothed belts, one on each side of the door; and in that movement of said toothed belts is synchronized via a gear means.

7. An arrangement according to claim 4, characterized in that the arrangement includes two toothed belts, one on each side of the door (12); and in that movement of said toothed belts is synchronized via a gear means (42, 48).

8. An arrangement according to claim 1, characterized in that the weight exerted by the counterbalance device (72) is divided uniformly along the lifting element (60).

9. An arrangement according claim 1, characterized by an elongated support (68) which functions to support the counterbalance device (72) in said horizontal position.

10. A drive arrangement for manoeuvering a substantially vertically moveable door, said arrangement comprising a bendable door lifting element which is connected at least to one of the two longitudinal side edges of the door, and an elongated, bendable counterweight device which is connected to the door lifting element and which is moveable by the door lifting element between an inactive position in which the counterweight device is generally horizontal and an active position in which at least part of the weight of the counterweight device exerts a lifting force on the door through the intermediary of said door lifting element.

11. An arrangement according to claim 10, characterized in that the counterweight device includes a plurality of mutually separate bodies which are connected to the lifting element in sequential relationship.

12. An arrangement according to claim 10, characterized in that the lifting element includes at least one endless drive belt.

13. An arrangement according to claim 12, characterized in that the drive belt is a toothed belt which is intended to coact with a belt pulley and guide pulleys, and in that said counterbalance device is formed on the non-toothed side of said toothed belt.

14. An arrangement according to claim 12, characterized in that the arrangement includes two toothed belts, one on each side of the door; and in that movement of said toothed belts is synchronized via a gear means.

15. An arrangement according to claim 10, characterized in that the weight exerted by the counterbalance device is divided ununiformly along the lifting element.

16. An arrangement according to claim 10, characterized by an elongated support which functions to support the counterbalance device in said horizontal position.

17. A drive arrangement for manoeuvering a substantially vertically moveable door, said arrangement comprising a bandable door lifting element which is connected at least to one of the two longitudinal side edges of the door, said lifting element including an endless drive belt, and an elongated, bendable counterweight device which is connected to the door lifting element and which is moveable by the door lifting element between an inactive position in which the counterweight device is generally horizontal and an active position in which at least part of the weight of the counterweight device exerts a lifting force on the door through the intermediary of said door lifting element, said counterweight device including a plurality of mutually separate bodies which are connected to the lifting element in sequential relationship.

18. A door apparatus, said apparatus comprising a substantially vertically moveable door (12) of the kind with which the force required to open the door increases with the extent to which the door is opened, and a drive arrangement for manoeuvering said door, said arrangement comprising a bendable door lifting element which is connected at least to one of the two longitudinal side edges of the door, characterized in that connected to the door lifting element (60) is an elongated, bendable counterweight device (72) which is intended to be moved by the door lifting element (60) between an inactive position in which the counterweight device is generally horizontal and an active position in which at least part of the weight of the counterbalance device exerts a lifting force on the door (12) through the intermediary of said door lifting element.

19. A door apparatus, said apparatus comprising a substantially vertically moveable door of the kind with which the force required to open the door increases with the extent to which the door is opened; and a drive arrangement for manoeuvering said door, said arrangement comprising a bendable door lifting element which is connected at least to one of the two longitudinal side edges of the door, and an elongated, bendable counterweight device which is connected to the door lifting element and which is moveable by the door lifting element between an inactive position in which the counterweight device is generally horizontal and an active position in which at least part of the weight of the counterweight device exerts a lifting force on the door through the intermediary of said door lifting element.

* * * * *